US007692393B2

(12) United States Patent
Caamano et al.

(10) Patent No.: US 7,692,393 B2
(45) Date of Patent: Apr. 6, 2010

(54) SYSTEMS AND METHODS FOR CONTROLLING SPOOLING OF LINEAR MATERIAL

(75) Inventors: Ramon Anthony Caamano, Gilroy, CA (US); Michael J. Lee, Center Ossipee, NH (US); James B. A. Tracey, Austin, TX (US); Martin Koebler, Sherman Oaks, CA (US)

(73) Assignee: Great Stuff, Inc., Austin, TX (US)

( * ) Notice: Subject to any disclaimer, the term of this patent is extended or adjusted under 35 U.S.C. 154(b) by 0 days.

(21) Appl. No.: 12/054,181

(22) Filed: Mar. 24, 2008

(65) Prior Publication Data

US 2008/0164363 A1 Jul. 10, 2008

Related U.S. Application Data

(63) Continuation of application No. 11/172,420, filed on Jun. 30, 2005, now Pat. No. 7,350,736.

(60) Provisional application No. 60/584,797, filed on Jul. 1, 2004, provisional application No. 60/585,042, filed on Jul. 2, 2004.

(51) Int. Cl.
*H04Q 9/00* (2006.01)
*G05D 1/02* (2006.01)

(52) U.S. Cl. ..... 318/16; 318/468; 254/264; 254/323

(58) Field of Classification Search ..... 318/16, 318/266, 280, 284, 466; 254/264, 275, 323, 254/267, 256, 368; 414/21, 463; 212/283; 49/197

See application file for complete search history.

(56) References Cited

U.S. PATENT DOCUMENTS

| | | | |
|---|---|---|---|
| 3,160,173 | A | 12/1964 | Bowen |
| 4,565,099 | A | 1/1986 | Arnold |
| 4,708,301 | A | 11/1987 | Kataoka |

(Continued)

FOREIGN PATENT DOCUMENTS

| | | |
|---|---|---|
| DE | 20304085 | 7/2003 |

(Continued)

OTHER PUBLICATIONS

Nordic, Hose Boss Rewind Assist, found at http://web.archive.org/web/20031212090707/http://www.nordicsystems.com/hoseboss.php, dated Dec. 12, 2003.

(Continued)

*Primary Examiner*—Paul Ip
(74) *Attorney, Agent, or Firm*—Knobbe Martens Olson & Bear, LLP

(57) ABSTRACT

Preferred embodiments of the invention comprise an automatic reel capable assisting a user when attempting to unspool a linear material, such as a water hose. The automatic reel includes a control system having a motor controller capable of sensing a pulling of, or increased tension of, the linear material and capable of causing a motor to rotate to unspool the linear material. In certain embodiments, the motor controller tracks the length of the unspooled portion of the linear material and/or reduces the spooling speed of the motor when retracting a terminal portion of the linear material.

12 Claims, 12 Drawing Sheets

U.S. PATENT DOCUMENTS

| | | | | |
|---|---|---|---|---|
| 4,718,168 | A * | 1/1988 | Kerr | 33/735 |
| 4,775,086 | A | 10/1988 | Kataoka | |
| 4,852,263 | A * | 8/1989 | Kerr | 33/735 |
| 5,160,055 | A * | 11/1992 | Gray | 212/278 |
| 5,398,911 | A * | 3/1995 | Holster | 254/267 |
| 5,440,820 | A | 8/1995 | Hwang | |
| 5,495,995 | A | 3/1996 | Dominique et al. | |
| 5,526,997 | A | 6/1996 | Karczmer et al. | |
| 5,793,174 | A * | 8/1998 | Kovach et al. | 318/468 |
| 5,808,824 | A | 9/1998 | Kaniwa et al. | |
| 5,841,259 | A | 11/1998 | Kim et al. | |
| 6,057,658 | A * | 5/2000 | Kovach et al. | 318/16 |
| 6,181,089 | B1 * | 1/2001 | Kovach et al. | 318/16 |
| 6,279,848 | B1 | 8/2001 | Mead, Jr. | |
| 6,369,530 | B2 * | 4/2002 | Kovach et al. | 318/16 |
| 6,474,922 | B2 * | 11/2002 | Bachman et al. | 414/21 |
| 6,536,615 | B2 * | 3/2003 | Nishikino et al. | 212/278 |
| 6,672,529 | B2 | 1/2004 | Cain et al. | |
| 6,782,662 | B2 * | 8/2004 | McCartney et al. | 49/197 |
| 6,913,221 | B2 | 7/2005 | Moon et al. | |
| 6,941,802 | B2 * | 9/2005 | Brown | 73/146 |
| 6,995,682 | B1 * | 2/2006 | Chen et al. | 340/825.72 |
| 7,028,989 | B2 * | 4/2006 | Flynn et al. | 254/323 |
| 7,150,572 | B2 | 12/2006 | McNestry et al. | |
| 7,159,851 | B1 * | 1/2007 | Ross et al. | 254/275 |
| 7,175,122 | B2 | 2/2007 | Bui et al. | |
| 7,185,881 | B2 * | 3/2007 | Drarvik et al. | 254/267 |
| 7,207,746 | B1 | 4/2007 | Legun | |
| 7,331,436 | B1 | 2/2008 | Pack et al. | |
| 7,350,736 | B2 | 4/2008 | Caamano et al. | |
| 7,364,106 | B2 | 4/2008 | Bui et al. | |
| 7,431,268 | B2 * | 10/2008 | Steiner et al. | 254/323 |
| 2002/0005451 | A1 * | 1/2002 | Valverde | 242/390.2 |
| 2002/0043510 | A1 * | 4/2002 | Bachman et al. | 212/283 |
| 2002/0184824 | A1 | 12/2002 | McCartney et al. | |
| 2004/0046078 | A1 | 3/2004 | Moon et al. | |
| 2004/0155137 | A1 | 8/2004 | Sharpe et al. | |
| 2004/0188582 | A1 * | 9/2004 | Flynn et al. | 248/329 |
| 2004/0231723 | A1 | 11/2004 | Harrington et al. | |
| 2005/0040276 | A1 * | 2/2005 | Sharpe et al. | 242/412 |
| 2005/0082517 | A1 * | 4/2005 | Steiner et al. | 254/323 |
| 2005/0160804 | A1 * | 7/2005 | Brown | 73/146 |
| 2005/0161545 | A1 | 7/2005 | Bui et al. | |
| 2005/0182732 | A1 | 8/2005 | Miller et al. | |
| 2005/0253125 | A1 * | 11/2005 | Drarvik et al. | 254/347 |
| 2006/0000936 | A1 | 1/2006 | Caamano et al. | |
| 2007/0014618 | A1 | 1/2007 | McNestry et al. | |
| 2007/0187540 | A1 | 8/2007 | Bui et al. | |
| 2007/0286661 | A1 | 12/2007 | McNestry et al. | |
| 2008/0074893 | A1 * | 3/2008 | Ham, II | 362/387 |
| 2008/0166167 | A1 | 7/2008 | McNestry et al. | |
| 2008/0224110 | A1 * | 9/2008 | Starks et al. | 254/264 |

FOREIGN PATENT DOCUMENTS

| | | | |
|---|---|---|---|
| EP | 0289475 | A | 11/1988 |
| EP | 0953536 | A | 11/1999 |

OTHER PUBLICATIONS

International Search Report and Written Opinion mailed Apr. 27, 2006; Appl. No. PCT/US2005/023652; 13 pages.
English translation of Office Action issued Jan. 23, 2009 in counterpart Chinese Patent Application No. 200580021640.X, in 8 pages.
U.S. Appl. No. 12/356,770, filed Jan. 21, 2009, *System and Methods for Controlling Spooling of Linear Material*, Caamano et al.
Office Action dated Jun. 5, 2009 in U.S. Appl. No. 12/356,770.
Office Action, with English translation, in Russian Patent Application No. 2007103743.
Office Action dated May 19, 2009 in New Zealand Patent Application No. 552230.

* cited by examiner

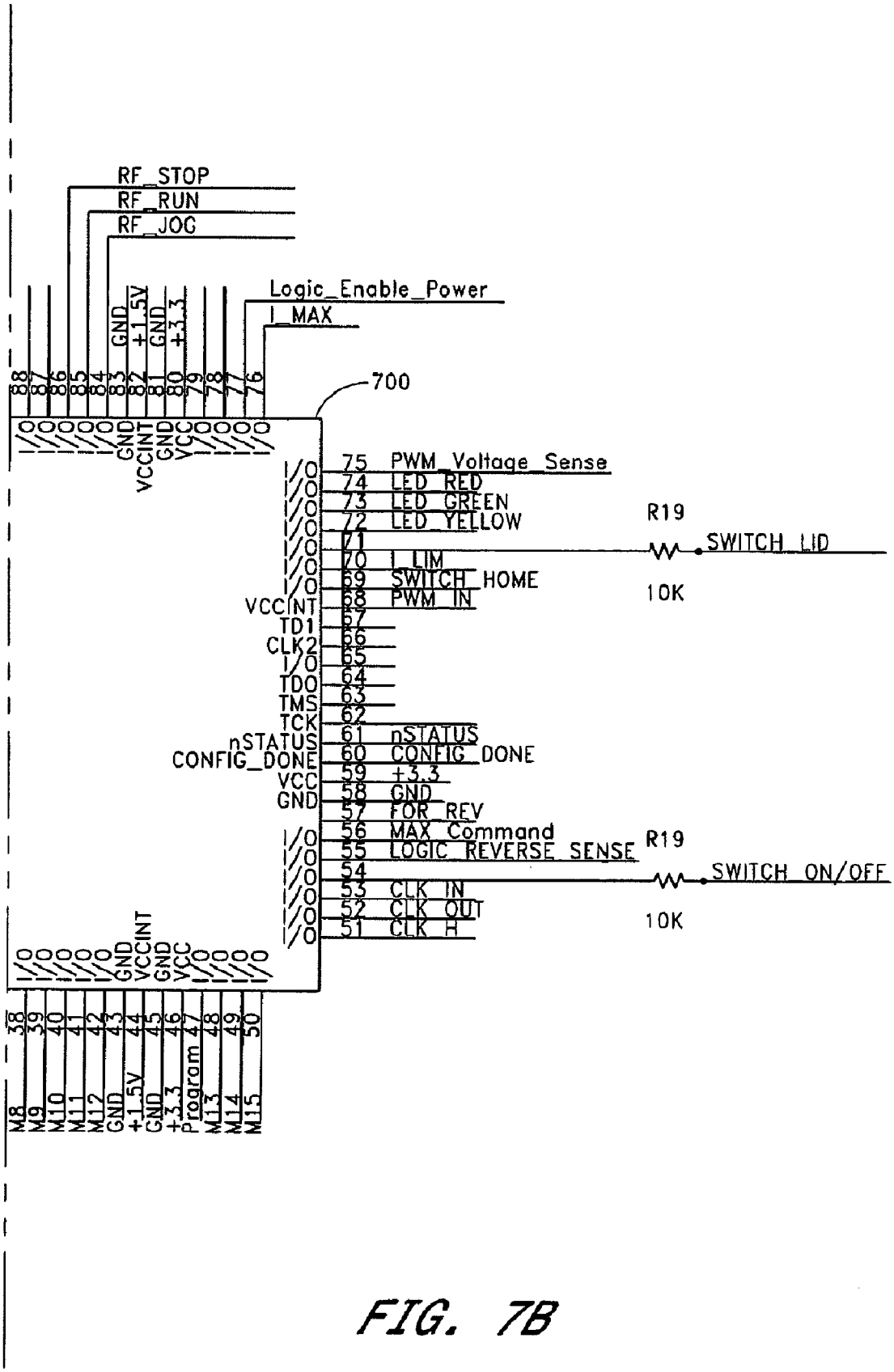
RF_STOP
RF_RUN
RF_JOG
Logic_Enable_Power
I_MAX
700
88 87 86 85 84 83 82 81 80 79 78 77 76
I/O I/O I/O I/O I/O GND +1.5V GND +3.3 I/O I/O I/O I/O
VCCINT GND VCC
75 PWM_Voltage_Sense
74 LED_RED
73 LED_GREEN
72 LED_YELLOW
71
70 I_LIM
69 SWITCH_HOME
68 PWM_IN
VCCINT
TD1
CLK2
I/O
TDO
TMS
TCK
nSTATUS
CONFIG_DONE
VCC
GND
67
66
65
64
63
62
61 nSTATUS
60 CONFIG_DONE
59 +3.3
58 GND
57 FOR_REV
56 MAX_Command
55 LOGIC_REVERSE_SENSE
54
53 CLK_IN
52 CLK_OUT
51 CLK_H
R19
SWITCH_LID
10K
R19
SWITCH_ON/OFF
10K
I/O I/O I/O I/O I/O

| | | |
|---|---|---|
| FIG. 10A | FIG. 10B | FIG. 10C |

SYSTEMS AND METHODS FOR CONTROLLING SPOOLING OF LINEAR MATERIAL

RELATED APPLICATIONS

This application is a continuation of U.S. patent application Ser. No. 11/172,420, filed Jun. 30, 2005, now U.S. Pat. No. 7,350,736, issued Apr. 1, 2008, which claims the benefit of priority under 35 U.S.C. §119(e) of U.S. Provisional Application No. 60/584,797, filed Jul. 1, 2004, entitled "SYSTEM AND METHOD FOR AUTOMATICALLY CONTROLLING SPOOLING OF LINEAR MATERIAL," and U.S. Provisional Application No. 60/585,042, filed Jul. 2, 2004, entitled "SYSTEM AND METHOD FOR AUTOMATICALLY CONTROLLING SPOOLING OF LINEAR MATERIAL," each of which is hereby incorporated herein by reference in its entirety.

BACKGROUND OF THE INVENTION

1. Field of the Invention

The present disclosure relates generally to systems and methods for spooling linear material and, in particular, to a motorized reel having a motor controller for controlling the spooling of linear material.

2. Description of the Related Art

Linear material, such as water hoses, can be cumbersome and difficult to manage. Mechanical reels have been designed to help spool such linear material onto a drum-like apparatus. Some conventional reels are manually operated, requiring the user to physically rotate the reel, or drum, to spool the linear material. This can be tiresome and time-consuming for users, especially when the hose is of a substantial length. Other reels are motor-controlled, and can automatically wind up the linear material. These automatic reels often have a gear assembly wherein multiple revolutions of the motor cause a single revolution of the reel. For example, some conventional automatic reels have a 30:1 gear reduction, wherein 30 revolutions of the motor result in one revolution of the reel.

However, when a user attempts to pull out the linear material from the automatic reel, the user must pull against the increased resistance caused by the gear reduction because the motor spins 30 times for every full revolution of the reel. Not only does this place an extra physical burden on the user, but the linear material experiences additional strain as well. Some automatic reels include a clutch system, such as a neutral position clutch, that neutralizes (or de-clutches) the motor to enable the user to freely pull out the linear material. This often requires the user to be at the site of the reel to activate the clutch. In addition, clutch assemblies can be expensive and substantially increase the cost of automatic reels.

Conventional automatic reel motors also tend to rotate reels at a constant rate. As a result, when the reel reaches the end of the linear material, such rotation can cause the end of the linear material to swing uncontrollably or even hit forcefully against the reel unit. This erratic movement can result in property damage or serious injury to nearby persons who may be hit by the linear material. Oftentimes, the user must also push a button or activate a control to stop the automatic reel from rotating. To account for such problems, some automatic reels incorporate expensive encoders that keep track of the amount of linear material left to be spooled.

SUMMARY OF THE INVENTION

Accordingly, a need exists for an automatic reel that assists a user when attempting to pull out, or unwind, a linear material, such as for example a garden hose. In addition, there is a need for an automatic reel that inexpensively keeps track of the length of the portion of the hose remaining to be retracted. A need also exists for an automatic reel having a motor controller that reduces the spooling speed of the motor when retracting a terminal portion of the hose.

In certain embodiments, the automatic reel actively assists a user attempting to withdraw a hose from the reel. For example, the automatic reel may sense a back, or reverse, electromagnetic force (EMF) signal created by the reverse spinning of the motor when the user pulls the hose from the reel. Upon sensing the reverse EMF signal, the motor controller causes the motor to rotate such that the wound garden hose is delayed from the reel.

In certain embodiments, the motor controller monitors the amount of hose wound on the reel. As the reel retracts the terminal portion of the hose, the motor controller causes the motor to operate at a lower speed, thereby decreasing the rate of retraction. Such a decrease in speed may prevent the end of the hose from causing damage or injury while being retracted into the reel.

In an embodiment, an automatic reel is disclosed for facilitating the spooling of linear material. The automatic reel includes a rotatable drum having a spool surface, the drum capable of winding a linear material around the spool surface as the drum rotates in a first direction, the drum further capable of deploying the linear material from around the spool surface as the drum rotates in a second direction. The reel further includes a motor capable of interacting with the drum to selectively rotate the drum in the first direction or in the second direction and includes control circuitry capable of outputting a control signal to cause the motor to rotate the drum in the second direction to deploy the linear material when the control circuitry detects a tension of the linear material above a predetermined amount.

In an embodiment, a method is disclosed for providing a motorized reel for spooling linear material. The method includes providing a rotatable member capable of rotating to wind a linear material around the rotatable member and providing a motor capable of interaction with the rotatable member to control a rotational velocity of the rotatable member. The method further includes providing a motor controller capable of outputting at least one signal to the motor to decrease the rotational velocity of the rotatable member while winding a terminal portion of the linear material.

In an embodiment, a motorized reel is disclosed for facilitating the spooling of linear material. The motorized reel includes a rotatable member capable of rotating to wind a linear material around the rotatable member, a motor capable of interacting with the rotatable drum in at least a first direction, and control circuitry capable of monitoring rotation of the rotatable drum by monitoring at least one motor signal to determine at least when an end of the linear material is approaching the rotatable drum.

In an embodiment, a reel is disclosed for automatically spooling a hose. The reel includes means for rotating to spool a hose, means for interacting with the means for rotating to control a rotational velocity of the means for rotating, and means for outputting at least one signal to the means for interacting to decrease the rotational velocity of the means for rotating while winding a terminal portion of the hose.

For purposes of summarizing the disclosure, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE PREFERRED EMBODIMENTS

Figure 1:
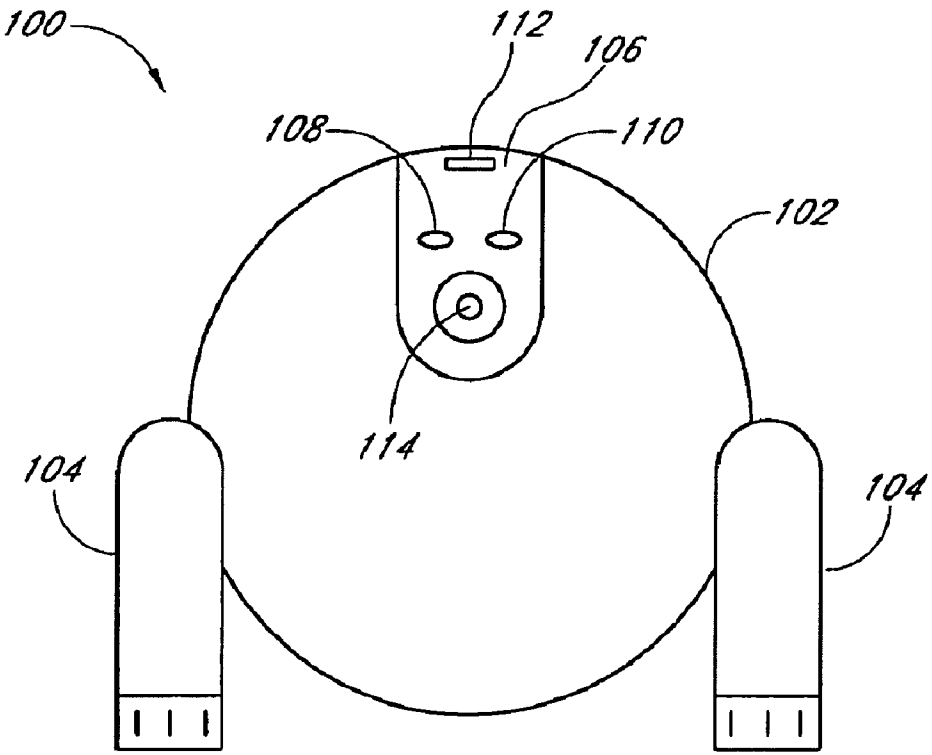
FIG. 1 illustrates a front elevation view of an exemplary embodiment of an automatic reel.

FIG. 1 illustrates an automatic reel 100 according to one embodiment of the invention. The illustrated automatic reel 100 is structured to spool a water hose, such as used in a garden or yard area. Other embodiments of the automatic reel 100 may structured to spool air hoses, pressure hoses, or other types of linear material that are used in a home setting, a commercial or industrial setting or the like The illustrated automatic reel 100 comprises a body 102 supported by a base formed by a plurality of legs 104 (e.g., four legs of which two legs are shown in FIG. 1). The body 102 advantageously houses several components, such as a motor, a motor controller, a reel mechanism (including a rotating drum), portions of the linear material (e.g., a hose) wound onto the drum, and the like. The body 102 is preferably constructed of a durable material, such as a hard plastic. In other embodiments, the body 102 may be constructed of a metal or other suitable material. In certain embodiments, the body 102 has a sufficient volume to accommodate a reel that holds a standard garden hose of approximately 100 feet in length. In other embodiments, the body 102 is capable of accommodating a reel for holding a standard garden hose of greater than 100 feet in length.

The illustrated legs 104 support the body 102 above a surface such as ground (e.g., a lawn) or a floor. The legs 104 may also advantageously include wheels, rollers, or other like devices to enable movement of the automatic reel 100 on the ground or other supporting surface. In certain embodiments of the invention, the legs 104 are capable of locking or being affixed to a certain location to prevent lateral movement of the automatic reel 100.

In certain embodiments, a portion of the body 102 is moveably attached to the base to allow a reciprocating motion of the automatic reel 100 as the hose is wound onto the internal reel. One example of a reciprocating mechanism is described in more detail in U.S. Pat. No. 6,279,848 to Mead, Jr., which is hereby incorporated herein by reference in its entirety. Certain structures and mechanisms described herein and not shown in the drawings are illustrated in the U.S. Pat. No. 6,279,848.

The illustrated automatic reel 100 also comprises an interface panel 106, which includes a power button 108, a select button 110 and an indicator light 112. The power button 108 controls the operation of the motor, which controls the automatic reel 100. For example, pressing the power button 108 activates the motor when the motor is in an off or inactive state. In certain embodiments, in order to account for premature commands or electrical glitches, the power button 108 may be required to be pressed for a predetermined time or number of time, such as, for example, at least about 0.1 second before turning on the motor. In addition, if the power button 108 is pressed and held for longer than about 3 seconds, the automatic reel 100 may turn off the motor and generate an error signal (e.g., activate the indicator light 112).

If the power button 108 is pressed while the motor is running, the motor is turned off. Preferably, commands issued through the power button 108 override any commands received from a remote control device (discussed below). In certain embodiments, the power button 108 may be required to be pressed for more than about 0.1 second to turn off the motor.

The illustrated interface panel 106 also includes the select button 110. The select button 110 may be used to select different options available to the user of the automatic reel 100. For example, a user may depress the select button 110 to indicate the type of size of linear material used with the automatic reel 100. In other embodiments, the select button 110 may be used to select a winding speed for the automatic reel 100.

The illustrated indicator light 112 provides information to a user regarding the functioning of the automatic reel 100. In an embodiment, the indicator light 112 comprises a fiber-optic indicator that includes a translucent button. In certain embodiments, the indicator light 112 is advantageously structured to emit different colors or to emit different light patterns to signify different events or conditions. For example, the indicator light 112 may flash a blinking red signal to indicate an error condition.

In other embodiments of the invention, the automatic reel 100 may comprise indicator types other than the indicator light 112. For example, the automatic reel 100 may include an indicator that emits an audible sound or tone.

Although the interface panel 106 is described with reference to particular embodiments, the interface panel 106 may include more or less buttons usable to control the operation of the automatic reel 100. For example, in certain embodiments, the automatic reel 100 advantageously comprises an "on" button and an "off" button.

Furthermore, the interface panel 106 may include other types of displays or devices that allow for communication to or from a user. For example, the interface panel 106 may include a liquid crystal display (LCD), a touch screen, one or more knobs or dials, a keypad, combinations of the same or the like. The interface panel 106 may also advantageously include an RF receiver that receives signals from a remote control device (discussed below).

The automatic reel 100 is preferably powered by a battery source. For example, the battery source may comprise a rechargeable battery. In an embodiment, the indicator light 112 is configured to display to the user the battery voltage level. For example, the indicator light 112 may display a green light when the battery level is high, a yellow light when the battery life is running out, and a red light when the battery level is low. In certain embodiments, the automatic reel 100 is configured to shut down the motor when the hose is in a fully retracted state and the battery voltage dips below a certain level, such as, for example, about 11 volts. This may prevent the battery from being fully discharged when the hose is spooled out from the automatic reel 100.

In addition to, or instead of, utilizing battery power, other sources of energy may be used to power the automatic reel 100. For example, the automatic reel 100 may comprise a cord that electrically couples to an AC outlet. In other embodiments, the automatic reel 100 may comprise solar cell technology or other types of powering technology.

As further illustrated in FIG. 1, the automatic reel 100 comprises a spooling port 114. The spooling port 114 provides a location on the body 102 through or over which a linear material may be spooled. In one embodiment, the spooling port 114 comprises a circular shape with a diameter of approximately 1 to 2 inches, such as to accommodate a standard garden hose. In other embodiments of the invention, the spooling port 114 may be located on a moveable portion of the body 102 to facilitate spooling. In certain embodiments, the spooling port 114 is sized such that only the hose passes therethrough during spooling. In such embodiments, the diameter of the spooling port 114 may be sufficiently small to block passage of a fitting and/or a nozzle at the end of the hose.

A skilled artisan will recognize from the disclosure herein a variety of alternative embodiments, structures and/or devices usable with the automatic reel 100. For example, the reel 100 may comprises any support structure, any base, and/or any console usable with embodiments of the invention described herein.

Figure 2:
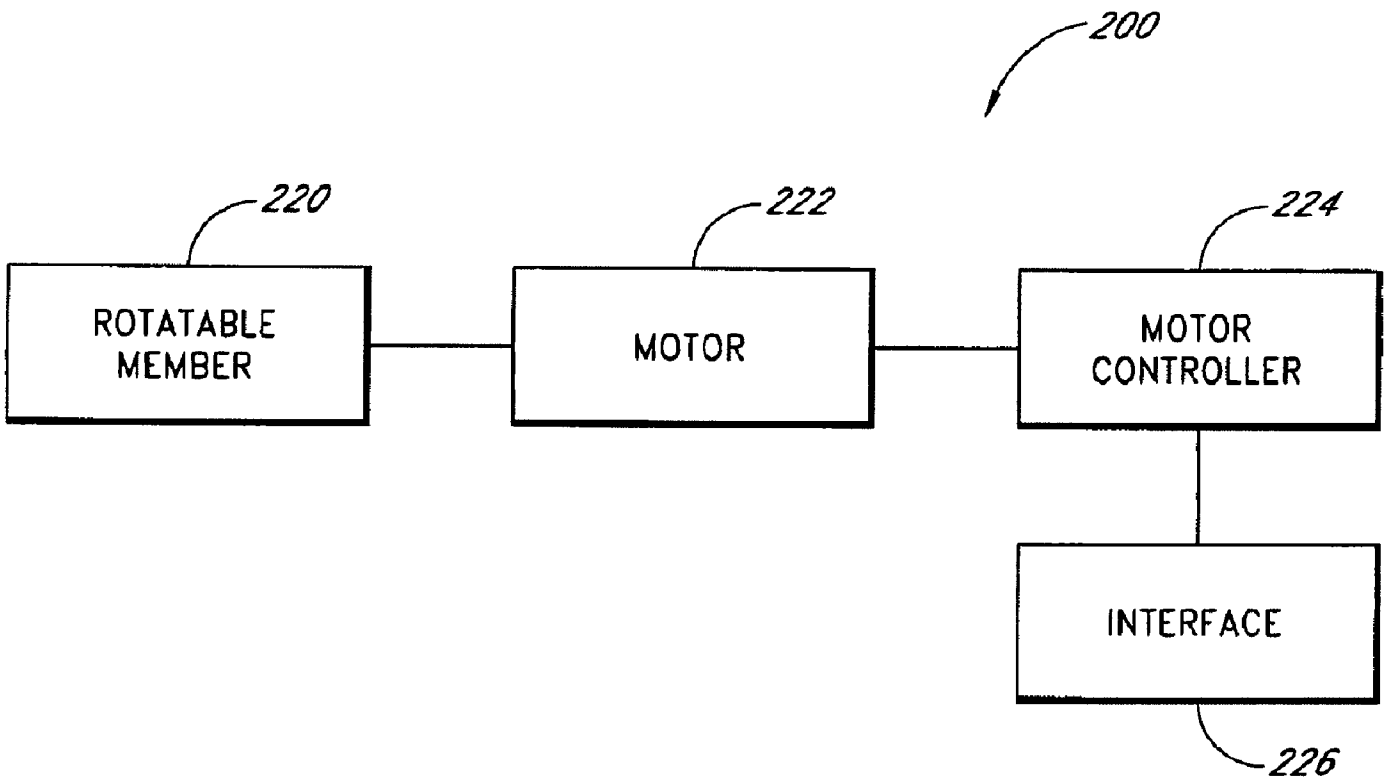
FIG. 2 illustrates a block diagram of an exemplary control system usable by the automatic reel of FIG. 1.

FIG. 2 illustrates a block diagram of an exemplary control system 200 usable to control the spooling and/or unspooling of a linear material. In certain embodiments, the automatic real 100 advantageously houses the control system 200 within the housing 102.

As shown in the block diagram of FIG. 2, the control system 200 comprises a rotatable member 220, a motor 222, a motor controller 224 and an interface 226. In general, the rotatable member 220 is powered by the motor 222 to spool and/or unspool linear material, such as a hose. In certain embodiments, the motor controller 224 controls the operation of the motor 222 based on stored instructions and/or instructions received through the interface 226.

In certain embodiments, the rotatable member 220 comprises a substantially cylindrical drum capable of rotating on at least one axis to spool linear material. In other embodiments, the rotatable member 220 may comprise other devices suitable for winding a linear material.

In an embodiment, the motor 222 of the automatic reel 100 comprises a brush DC motor (e.g., a conventional DC motor having brushes and having a commutator that switches the applied current to a plurality of electromagnetic poles as the motor rotates). The motor 222 advantageously provides power to rotate the drum 220 inside the automatic reel 100 to spool the hose onto the drum 220, thereby causing the hose to retract into the body 102.

In an embodiment of the invention, the motor 222 is coupled to the drum via a gear assembly. For example, the automatic reel 100 may advantageously comprise a gear assembly having an about 30:1 gear reduction, wherein about 30 revolutions of the motor 222 produce about one revolution of the drum 220. In other embodiments, other gear reductions may be advantageously used to facilitate the spooling of hose. In yet other embodiments, the motor may comprise a brushless DC motor 222, a stepper motor, or the like.

In certain embodiments of the invention, the motor 222 operates within a voltage range between about 10 and about 15 volts and consumes up to approximately 250 watts. Under normal load conditions, the motor 222 may exert a torque of approximately 120 ounce-inches (or approximately 0.85 Newton-meters) and operate at approximately 2,500 RPM. Preferably, the motor 222 also is capable of operating within an ambient temperature range of approximately about 0° C. to about 40° C., allowing for a widespread use of the reel 100 in various types of weather conditions.

In certain embodiments, the motor 222 advantageously operates at a rotational velocity selected to cause the drum 220 to completely retract a 100-foot garden hose within a period of approximately 30 seconds. However, as a skilled artisan will recognize from the disclosure herein, the retraction time may vary according to the type of motor used and the type and length of linear material spooled by the automatic reel 100.

In certain embodiments, the motor 222 is configured to retract hose at a maximum velocity of, for example, between approximately 3 and approximately 4 feet per second. In certain preferred embodiments, the motor 222 is configured to retract hose at a maximum velocity of approximately 3.6 feet per second. To maintain the hose retraction velocity below a selected maximum velocity, the motor 222 may advantageously operate at different speeds during a complete retraction of the hose. For instance, the retraction velocity of the hose may be proportional to the diameter of the layers of hose wound on the drum 220. Thus, in order to achieve a relatively high velocity when the hose is initially retracted, yet stay below the maximum velocity as the diameter of the hose on the reel 100 increases, the rotational velocity (e.g., the RPM) of the drum 220 decreases as more hose is spooled onto the reel 100.

One skilled in the art will recognize from the disclosure herein that the automatic reel 100 need not retract the hose at a constant velocity. For example, the reel motor 222 may operate at a constant RPM throughout the retraction process. In such an embodiment, the rate of retraction may increase as more hose is spooled into the reel 100.

In one particularly advantageous embodiment, the rotational velocity of the motor 222 decreases to reduce the linear retraction velocity of the hose when a relatively short length of hose remains to be spooled onto the drum 220. Such a motor velocity reduction may protect against injury and property damage by preventing the end of the hose from being too forcefully retracted into the automatic reel 100.

Figure 3:
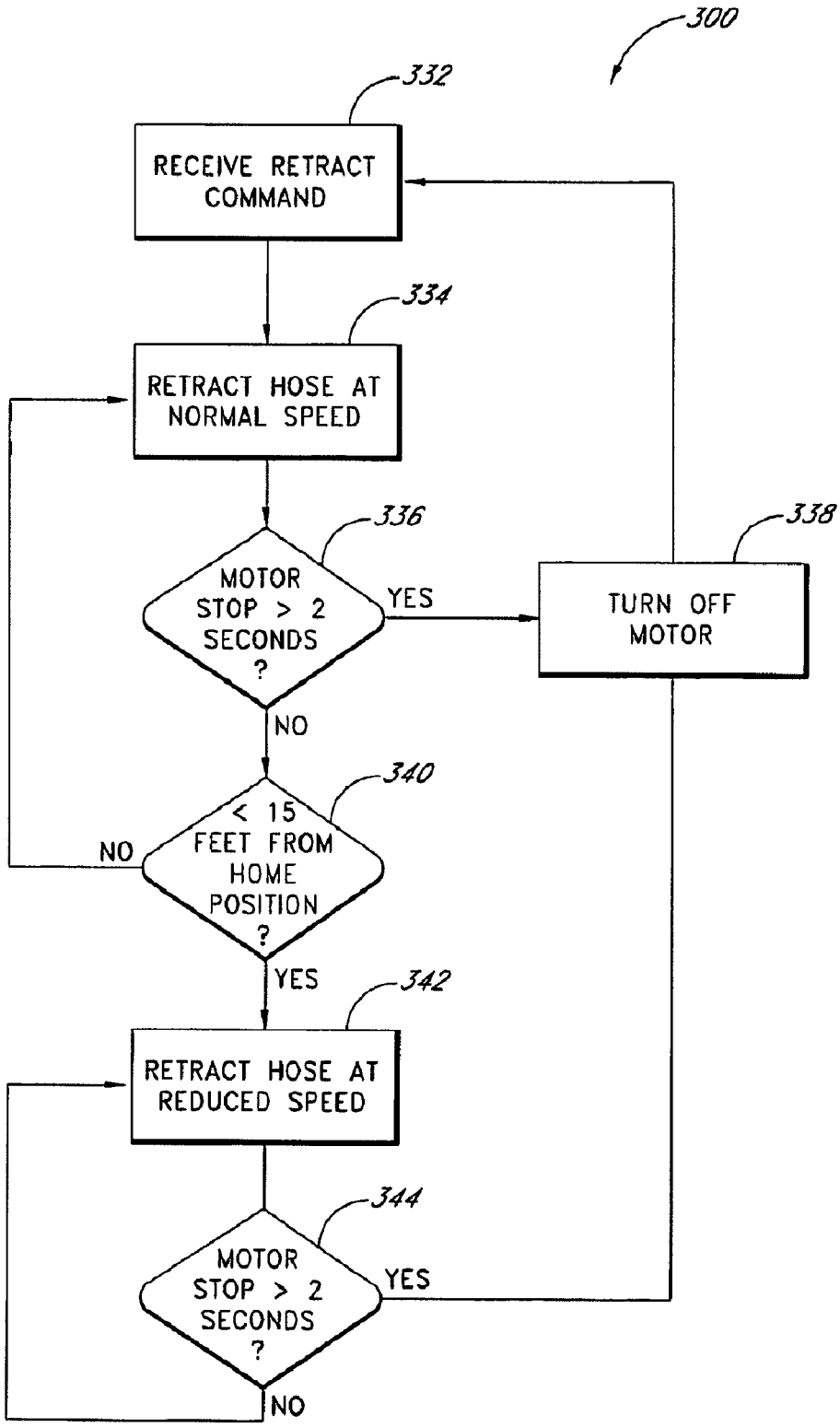
FIG. 3 illustrates a flow chart of an exemplary embodiment of a variable retraction speed process usable by the control system of FIG. 2.

One example of a method for reducing a retraction speed toward an end of a hose is illustrated by a variable retraction speed process 300 represented by the flow chart in FIG. 3. In one embodiment, the motor controller 224, which controls the operation of the motor 222, executes the variable retraction speed process 300 of FIG. 3 to change the speed of retraction of the automatic reel 100. For example, the motor controller 224 may execute the variable retraction speed process 300 to vary the retraction speed when a hose is almost fully retracted into the automatic reel 100, such as when 15 feet of hose remains to be retracted.

For exemplary purposes, the execution of the variable retraction speed process 300 will be described herein with reference to the control system components illustrated in FIG. 2.

The process 300 begins at Block 332 wherein the motor controller 224 receives a command to retract a linear material, such as a hose, associated with the reel 100. Such a command may be received, for example, through the interface 226. At Block 334, the reel 100 retracts the hose at a first, or normal, speed. For example, the motor 222 of the reel 100 may rotate the drum 220 to retract the hose at a speed of approximately 3.33 feet per second.

In certain preferred embodiments, the speed of the motor 222 is controlled by pulse width modulation (PWM) in accordance with well-known techniques. In particular, the motor controller 224 may control the speed of the motor 222 by varying the duty cycle of the DC current applied to the motor 222.

At Block 336, the motor controller 224 determines if the motor 222 has stopped rotating for a predetermined period of time, such as, for example, more than two seconds. If the motor 222 has stopped rotating for longer than the particular duration of time, the process 300 proceeds with Block 338, wherein the motor controller 224 turns off the motor 222.

If the motor 222 has not stopped rotating for the predetermined length of time, the process 300 proceeds with Block 340, wherein the motor controller 224 determines if a retraction position of the hose (e.g., the portion of the hose entering the reel 100 at the port 114) is less than approximately fifteen feet from a "home" position. For example, the "home" position may correlate to the end of the hose, and in Block 340, the motor controller 224 may determine when there is approximately fifteen feet left of the hose to be retracted. In certain embodiments, the motor controller 224 determines the "home" position during a prior wind cycle, such as when substantially all of the hose has been retracted. In other embodiments, the motor controller 224 may calculate the home position through the use of encoders, or the user may input data regarding the home position (e.g., by entering the total length of the linear material).

Preferably, the motor controller 224 advantageously keeps track of the length of hose that has been retracted. In certain embodiments, the motor controller 224 advantageously inexpensively tracks the length of hose by, for example, monitoring the existing electronics. In some embodiments, such monitoring occurs in the absence of expensive encoders that may be found on other conventional automatic reels.

In certain embodiments, the automatic reel 100 monitors the current applied to the motor 222, such as a brush DC motor, and determines the speed of the motor 222 based on the measured current. By determining the speed of the motor 222 and by keeping track of the time during which the motor 222 operates at a particular speed, the motor controller 224 in the automatic reel 100 is able to calculate the number of revolutions of the motor 222 and, hence, is able to calculate the number of revolutions of the drum 220 of the automatic reel 100.

The length of hose retracted onto the drum 220 is determinable from the number of revolutions of the drum 220 and the diameter of the layers of hose on the drum 220. Thus, as the reel 100 retracts the hose, the motor controller 224 is able to determine when a sufficient length of hose is retracted such that the terminal portion (e.g., the last 15 feet) of the hose is entering the hose port 114. When the motor controller 224 makes this determination, the motor controller 224 reduces the duty cycle of the PWM pulses to reduce the rotational velocity of the motor 220, and thus reduce the linear velocity of the hose as the hose is retracted during the last 15 feet (or other selected length).

In other embodiments, lengths other than approximately fifteen feet may be used when executing the process 300 to control the retraction speed of the linear material. For example, the particular length may be set and/or adjustable by the user through the interface panel 106.

With continued reference to the process 300 of FIG. 3, if the retraction position is fifteen feet or more from the "home" position, the process 300 returns to Block 334, wherein the reel 100 continues to retract the hose at the normal speed.

If the retraction position is less than fifteen feet from the "home" position, the process 300 continues with Block 342, wherein the motor controller 224 reduces the speed of the motor 222 in order to retract the hose at a slower speed. For example, the motor controller 224 may reduce the retraction speed to one-half of the first, or normal, speed to approximately 1.67 feet per second.

At Block 344, the motor controller 224 determines if the motor t222 has stopped rotating for a predetermined period of time, such as, for example, more than two seconds. If the motor 222, has stopped rotating for longer than the particular duration of time, the process 300 proceeds with Block 338, wherein the motor controller 224 turns off the motor 222. For example, if the end of the hose engages the port 114 such that the hose end cannot pass therethrough, the motor 222 is not able to continue to rotate and is subsequently turned off by the motor controller 224.

If the motor 222 has not stopped rotating for the predetermined length of time, the process 300 returns to Block 342, wherein the motor 222 continues to retract the hose at the reduced speed.

In certain embodiments, the motor controller 224 operates in a voltage range from about 10 to about 14.5 volts and consumes up to approximately 450 watts. In an embodiment, the motor controller 224 preferably consumes no more than approximately 42 amperes of current. To protect against current spikes that may damage the motor controller 224 and/or the motor 222 and pose potential safety hazards, certain embodiments of the motor controller 224 advantageously include a current sense shut-off circuit. In such embodiments, the motor controller 224 automatically shuts down the motor 222 when the current threshold is exceeded for a certain period of time. For example, the motor controller 224 may sense current across a single MOSFET or across another current sensing device or component. If the sensed current exceeds 42 amperes for a period of more than approximately two seconds, the motor controller 224 advantageously turns off the motor 222 until the user clears the obstruction and restarts the motor controller 224. In other embodiments, the current threshold and the time period may be selected to achieve a balance between safety and performance.

For example, and with particular applicability to Blocks 336, 338 and 344 of FIG. 3, a current spike may occur when the hose encounters an obstacle while the automatic reel 100 is retracting the hose. For example, the hose may snag on a rock, on a lounge chair or on other types obstacles, which could prevent the hose from being retracted any further by the automatic reel 100. At that point, the motor 222 (and drum 220) may stop rotating and thereby cause a spike in the sensed current draw. As a safety measure, the motor controller 224 advantageously shuts down the motor 222 until the motor controller 224 receives another retract command from the user, preferably after any obstacle has been removed. Also preferably, the maximum current limit is set so that small current spikes do not shut down the motor 222, for example, when the hose encounters small obstacles during retraction that do not fully prevent the hose from being retracted but that cause a temporary slowing of the retraction of the hose with a commensurate temporary increase in current.

In certain embodiments, the motor controller 224 also uses the current sensor to determine when the hose is fully retracted into the automatic reel 100 and is wound onto the internal drum 220. In particular, when a fitting at the end of the hose is blocked from further movement by the hose port 114, the hose cannot be further retracted and the drum 220 can no longer turn. The current applied to the motor 222 increases as the motor 222 unsuccessfully attempts to turn the drum 220. The motor controller 224 senses the current spike and shuts down the motor 222. In certain embodiments, the motor controller 224 assumes that the current spike was caused by the completion of the retraction process, and the motor controller 224 establishes the current position of the hose as the "home" position. Until a new "home" position is established, the length of the hose extracted from the automatic reel 100 is determined by the number of turns in the reverse direction, as discussed above, and the length of the hose returned to the drum 220 is determined by the number of turns in the forward direction, as discussed above.

On the other hand, if the current spike was caused by an external obstruction, the user can release the hose from the obstruction and press the home button on a remote control or activate a home function using the interface panel 106 on the automatic reel 100. When the motor controller 224 is activated in this manner, the motor controller 224 again operates the motor 222 in the forward direction to further retract the hose. When the motor controller 224 senses another current spike, a new "home" position is established. By using the sensing of the current spike to establish the home position, the embodiments of the automatic reel 100 described herein do not require a complex mechanical or electrical mechanism to determine when the hose is fully retracted. The skilled artisan will recognize from the disclosure herein a wide variety of alternative methods and/or devices for tracking the amount of linear material retracted and/or the retraction speed of the linear material. For example, the reel 100 may use an encoder, such as an optical encoder, or use a magnetic device, such as a reed switch, or the like.

One skilled in the art will recognize from the disclosure herein that the maximum current may be set for more than 42 amperes or set to less than 42 amperes depending upon the design of the controller 224 and the automatic reel 100.

In certain embodiments, the motor controller 224 advantageously has two modes—a sleep mode and an active mode. The motor controller 224 operates in the active mode whenever an activity is occurring, such as, for example, the extension of the hose by a user or the retraction of the hose in response to a command from the user. The motor controller 224 also operates in the active mode while receiving commands from a user via the interface panel 106 or via a remote control. The current required by the motor control board during the active mode may be less than about 30 milliamperes.

In order to conserve energy, the motor controller 224 is advantageously configured, in certain embodiments, to enter the sleep mode when no activity has occurred for a certain period of time, such as, for example, 60 seconds. During the sleep mode, the current required by the motor controller 224 is advantageously reduced. For example, the motor controller 224 may require less than about 300 microamperes in the sleep mode.

Figure 4:
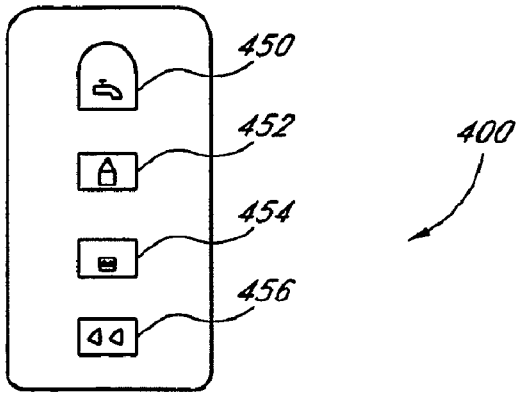
FIG. 4 illustrates an exemplary embodiment of a remote control for use with the automatic reel of FIG. 1.

FIG. 4 illustrates a remote control 400 that enables a user to manually control the automatic reel 100 without having to use the interface panel 106. In certain embodiments, the remote control 400 operates a flow controller of the automatic reel 100 and also operates the motor 222 to wind and unwind the hose onto and from the drum 220. For example, the remote control 400 may communicate with the motor controller 224 described above.

Preferably, the remote control 400 operates on a DC battery, such as a standard alkaline battery. In other embodiments, the remote control 400 may be powered by other sources of energy, such as a lithium battery, solar cell technology, or the like.

The illustrated remote control 400 includes one or more buttons for controlling hose reel operation. In the illustrated embodiment, the remote control 400 includes a valve control button 450, a "home" button 452, a "stop" button 454, and a "jog" button 456. Note that the use of symbols on these buttons may mimic standard symbols on tape, compact disc, and video playback devices.

Pressing the valve control button 450 sends a signal to the electronics of the automatic reel 100 to cause a flow controller therein to toggle an electrically actuated valve between open and closed conditions to control the flow of a fluid (e.g., water) or a gas (e.g., air) through the hose.

Pressing the home button 452 causes the motor controller 224 to enable the motor 222 to wind the hose onto the drum 220 within the automatic reel 100. In certain embodiments, the hose is retracted and wound onto the reel 100 at a quick speed after the home button 452 has been pressed. For example, a 100-foot hose is advantageously wound onto the reel drum 220 in approximately thirty seconds.

Pressing the stop button 454 causes the motor controller 224 to halt the operation of the motor 222 in the automatic reel 100 so that retraction of the hose ceases. In certain embodiments, the stop button 454 provides a safety feature such that commands caused by the stop button override commands issued from the home button 452.

The jog button 456 allows the user to control the amount of hose that is reeled in by the hose reel 100. For example, in an embodiment, pressing the jog button 456 causes the hose reel 100 to reel in the hose for as long as the jog button 456 is depressed. When the user releases the jog button 456, the automatic reel 100 stops retracting the hose. In certain embodiments, the rate at which the reel 100 retracts the hose when the jog button 456 is pressed is less than the initial rate at which the reel 100 retracts the hose after the home button 452 is pressed. Because the hose is only retracted during the time the jog button 456 is pressed, the motor speed when retracting the hose in response to pressing the jog button 456 is preferably substantially constant.

In other embodiments, pressing the jog button 456 advantageously causes the reel 100 to retract the hose a set length or for a set time period. For example, in one embodiment, each activation of the jog button 456 advantageously causes the reel 100 to retract the hose approximately ten feet. In such embodiments, the jog button command may be overridden by the commands caused by pressing the home button 452 or the stop button 454. Commands from the remote control 400 may also be overridden by commands initiated by using the interface panel 106 on the automatic reel 100.

In certain embodiments, the remote control 400 advantageously communicates with the automatic reel 100 via wireless technologies. For example in a preferred embodiment, the remote control 400 communicates via radio frequency (RF) channels and does not require a line-of-site communication channel with the reel 100. Furthermore, the remote control transmitter is advantageously able to communicate over a range that exceeds the length of the hose. For example, for an automatic reel 100 configured for a 100-foot hose, the communication range is advantageously set to be at least about 110 feet. In other embodiments, the remote control 400 is configured to communicate via other wireless or wired technologies, such as, for example, infrared, ultrasound, cellular technologies or the like.

In certain embodiments, the remote control 400 is configured so that a button on the remote control 400 must be pressed for a sufficient duration (e.g., at least about 0.1 second) before the remote control 400 transmits a valid command to the automatic reel 100. This feature precludes an unwanted transmission if a button is inadvertently touched by the user for a short time.

In certain embodiments, the remote control 400 is configured so that if any button is pressed for more than three seconds (with the exception of the jog button 456), the remote control 400 advantageously stops transmitting a signal to the automatic reel 100. This conserves battery power and inhibits sending of mixed signals to the automatic reel 100, such as when, for example, an object placed on the remote control 400 causes the buttons to be pressed without the user's knowledge.

Preferably, the transmitter of the remote control 400 and the receiver in the automatic reel 100 are synchronized prior to use. In addition or in the alternative, the two devices are synchronized after the batteries have been changed in either device. In certain embodiments, the devices are advantageously synchronized by pressing both the home button 452 and the stop button 454 on the remote control 400 for longer than three seconds while the automatic reel 100 is on. In certain embodiments, the user advantageously receives confirmation that the synchronization is complete by observing a flashing LED on the automatic reel 100 or by hearing an audible signal generated by the automatic reel 100.

In certain preferred embodiments, the remote control 400 is advantageously configured to power down to a "sleep" mode when no button of the remote control 400 has been pressed during a certain time duration. For example, if a period of 60 seconds has elapsed since a button on the remote control 400 was last pressed, the remote control 400 enters a "sleep" mode wherein the current is reduced from the current consumed during an "active" state. When any of the buttons on the remote control 400 is pressed from more than 0.1 second, the remote control 400 enters the "active" state and begins transmitting.

In an embodiment of the invention, the remote control 400 is advantageously attachable to the hose at or near the extended end of the hose. In other embodiments, the remote control 400 is not attached to the hose. In the latter case, the user can operate the remote control 400 to stop the flow of water and retract the hose without entering the area where the hose is being used. Embodiments of the remote may also take on any shape with similar and/or combined functions.

In certain embodiments, the automatic reel 100 preferably includes a reverse-assist function to reduce the effort required by a user to pull (or unspool) hose from the drum 220 within the automatic reel 100. The reverse-assist function counteracts at least a portion of the effect of pulling against the large gear reduction of the automatic reel 100. For example, when the user pulls on the hose, the internal drum turns and causes the motor 222 to turn in the reverse direction.

Figure 5:
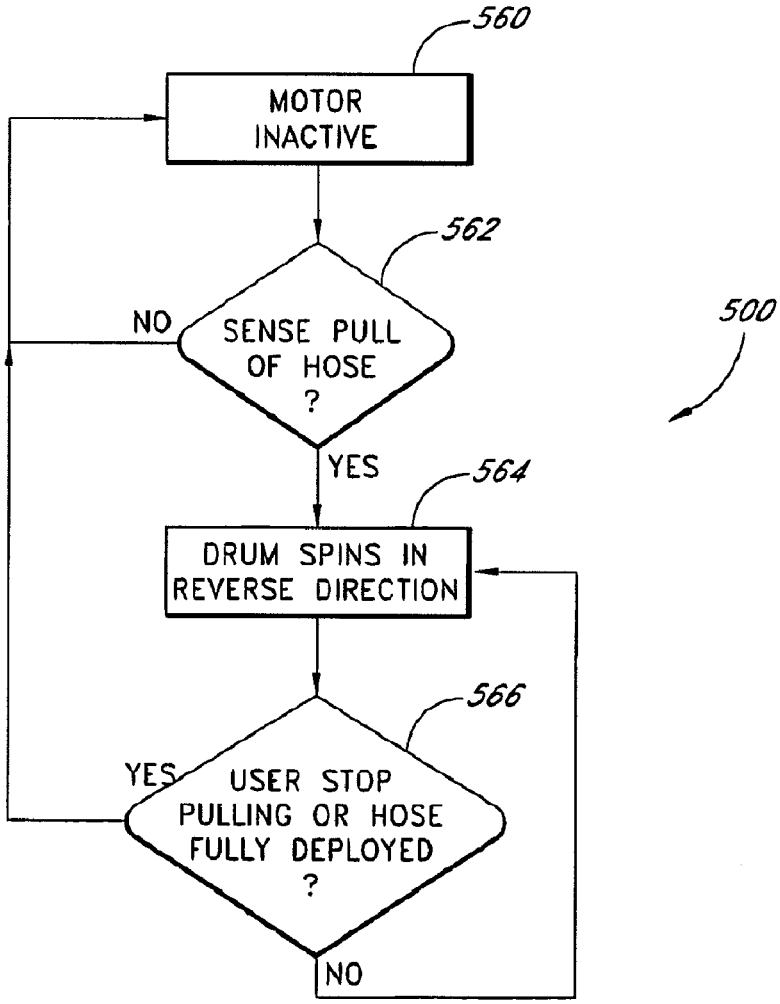
FIG. 5 illustrates a flow chart of an exemplary embodiment of a reverse-assist process usable by the control system of FIG. 2.

FIG. 5 illustrates a flow chart of a reverse-assist process 500 usable to facilitate the unspooling of linear material, such as a hose, from an automatic reel. For exemplary purposes, the process 500 will be described with reference to the control system 200 components of FIG. 2.

The reverse-assist process 500 begins at Block 560, wherein the motor 222 is in an inactive state. At Block 562, the motor controller 224 determines if the hose is being pulled, such as by a user trying to unspool the hose from the automatic reel 100. For example, in certain embodiments, the motor controller 224 detects a tension of the hose above a predetermined amount, such as, for example, a tension that causes the motor 222 to spin in the reverse direction. If the motor controller 224 does not sense a pull or increased of the hose, the process 500 returns to Block 560. If the motor controller 224 senses that the hose is being pulled, the process 500 proceeds with Block 564.

In certain embodiments wherein the motor 222 comprises a brush DC motor, the motor controller 224 senses a reverse EMF to determine when the hose is being pulled. When the motor 222 is inactive, the motor controller 224 does not provide power to the motor 222. As the user pulls on the hose, the turning of the brush DC motor generates a detectable reverse EMF, which is sensed by the motor controller 224. In certain embodiments, if the motor controller 224 is initially in the sleep mode, it enters the active mode.

Once the motor controller 224 senses the pulling of the hose, the motor controller 224 causes the motor 222 to rotate in a reverse direction (i.e., a direction opposite the rotation direction used to spool the hose). This reverse rotation of the motor 222 causes reverse rotation of the drum 220 to unspool portions of the hose wound thereon, which is illustrated by Block 564.

In certain embodiments, the motor controller 224 operates a relay or other suitable switching device to reverse the direction of the current applied to the motor 222. The reverse current causes the motor 222 to turn the drum 220 of the automatic reel 100 such that the hose is unspooled (e.g., ejected from the automatic reel 100 via the hose port 114). In certain preferred embodiments, the motor 222 is controlled to turn the drum 220 at a rotational velocity less than the rotational velocity of the drum 220 when the automatic reel 100 is retracting the hose. For example, this may be accomplished in preferred embodiments by controlling the duty cycle of the PWM signals that control the current applied to the motor 222.

In certain embodiments, the lower rotational velocity of the drum 220 inhibits overspooling and thus inhibits the creation of unwanted looseness of the hose around the drum 220 inside the automatic reel 100. The lower rotational velocity also allows the user to pull on the hose at the same rate that the hose is ejected from the hose port 114 so that the ejected hose does not develop kinks proximate the automatic reel 100.

In certain embodiments, the motor controller 224 causes reverse rotation of the motor 222 and the drum 220 for a predetermined period of time. For example, when the motor controller 224 senses a pulling of the hose, the motor controller 224 may cause the drum 220 to rotate to unspool hose for five seconds. In other embodiments, the motor controller 224 may cause the drum 220 to unspool a predetermined length of the hose (e.g., approximately 10 feet) or may cause the drum 220 to perform a certain number of rotations (e.g., 10 rotations).

Furthermore, in certain embodiments, during Block 564 of the reverse-assist process 500, the motor controller 224 determines the number of turns of the drum 220 in the reverse direction by monitoring the current applied to the motor 222 (as discussed above) so that the length of hose extracted from the automatic reel 100 is known.

At Block 566, the motor controller 224 determines if the user has stopped pulling the hose or if the hose has been fully deployed, and if so, the motor controller 224 causes the motor 222 to stop rotating. If the user has not stopped pulling the hose and if the hose is not fully deployed, the process 500 returns to Block 564 wherein the drum 220 continues to rotate to unspool the hose.

Although described with reference to particular embodiments, the skilled artisan will recognize from the disclosure herein a wide variety of alternatives to the reverse-assist process 500. For example, in certain embodiments, the remote control 400 advantageously includes a "forward" button (not shown) to activate the automatic reel 100 to operate the motor 222 in the reverse direction to unwind the hose from the drum 220 within the automatic reel 100.

The skilled artisan will also readily appreciate from the disclosure herein numerous modifications that can be made to the electronics to operate the flow controller and a hose reel device. For example, the above processes 300 and/or 500 may be implemented in software, in hardware, in firmware, or in a combination thereof. In addition, functions of individual components, such as the motor controller 224, may be performed by multiple components in other embodiments of the invention.

FIGS. 6-9 illustrate schematic diagrams of an exemplary embodiment of a motor controller, such as the motor controller 224 of FIG. 2, that performs at least some of the functions described above. The following description and references to FIGS. 6-10C are for exemplary purposes only and not to limit the scope of the disclosure. The skilled artisan will recognize from the disclosure hereinafter a variety of alternative structures, devices and/or processes usable in place of, or in combination with, the embodiments of the invention described hereinafter.

Figure 6:
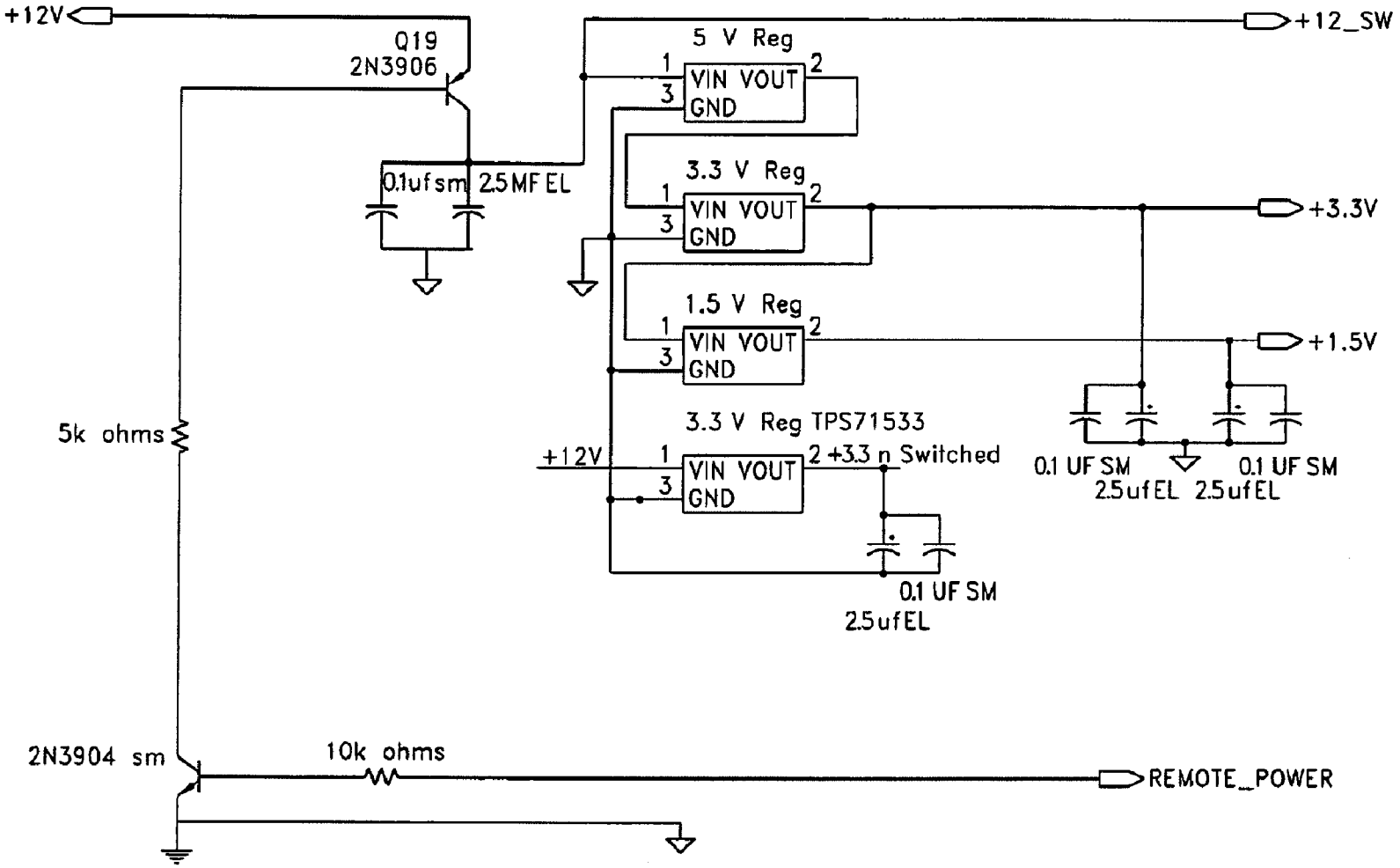
FIGS. 6-9 illustrate schematic diagrams of exemplary electronic circuitry of a motor controller of the automatic reel of FIG. 1.

In particular, FIG. 6 illustrates first, second and third voltage regulators that derive regulated 5 volts, 3.3 volts, and 1.5 volts, respectively, from a 12-volt voltage source. The inputs to the regulators are switched in response to a REMOTE_POWER input signal, which is selectively activated when the motor controller 224 is in the active mode and deactivated when the motor controller is the sleep mode, as described above. Thus, the voltages from the first, second and third regulators are available when the motor controller 224 is in the active mode.

The motor controller also includes a fourth voltage regulator that provides a regulated 3.3 volts from the 12-volt source. Unlike the inputs to the other three regulators, the input to the fourth regulator is not switched, and the unswitched 3.3 volts provided by the fourth regulator is generally available whenever the 12-volt source is active (e.g., the 12-volt source is connected to the motor controller and has a sufficient charge).

Figure 7:
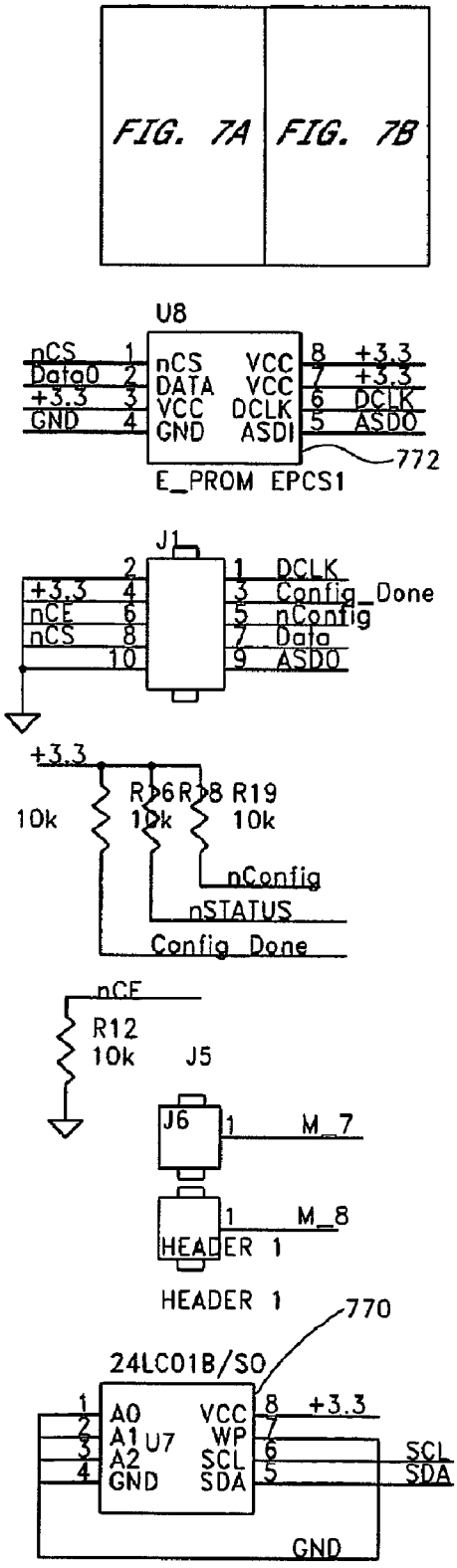
Figure 7A:
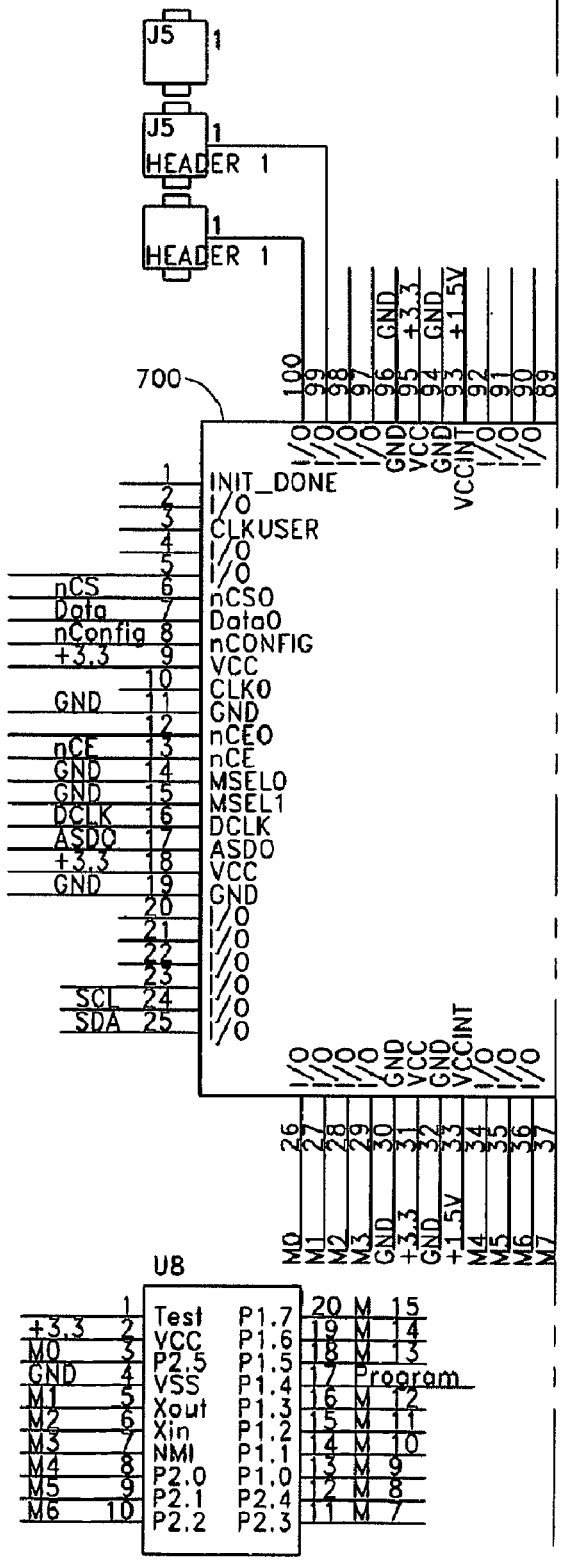

As illustrated in FIGS. 7A and 7B, the motor controller includes a field programmable gate array (FPGA) 700, such as, for example, a Cyclone™ FPGA available from Altera Corporation. The FPGA 700 is programmed to perform the functions described herein and includes, for example, the functional blocks illustrated in FIGS. 10A-10C. For example, the FPGA 700 implements an RF command functional block 1002 in FIG. 10A that decodes the RF data received from a remote control, such as the remote control 400, via an RF receiver (not shown). The RF command functional block 1002 generates internal signals (e.g., a reel-in ("home") signal to cause the retraction process; a reel-in ten feet signal ("jog") to cause the hose to be retracted 10 feet and then stopped, and a stop signal to cease all movement). The outputs of the RF command block 1002 are provided to other functional blocks.

Figures 10, 10A:
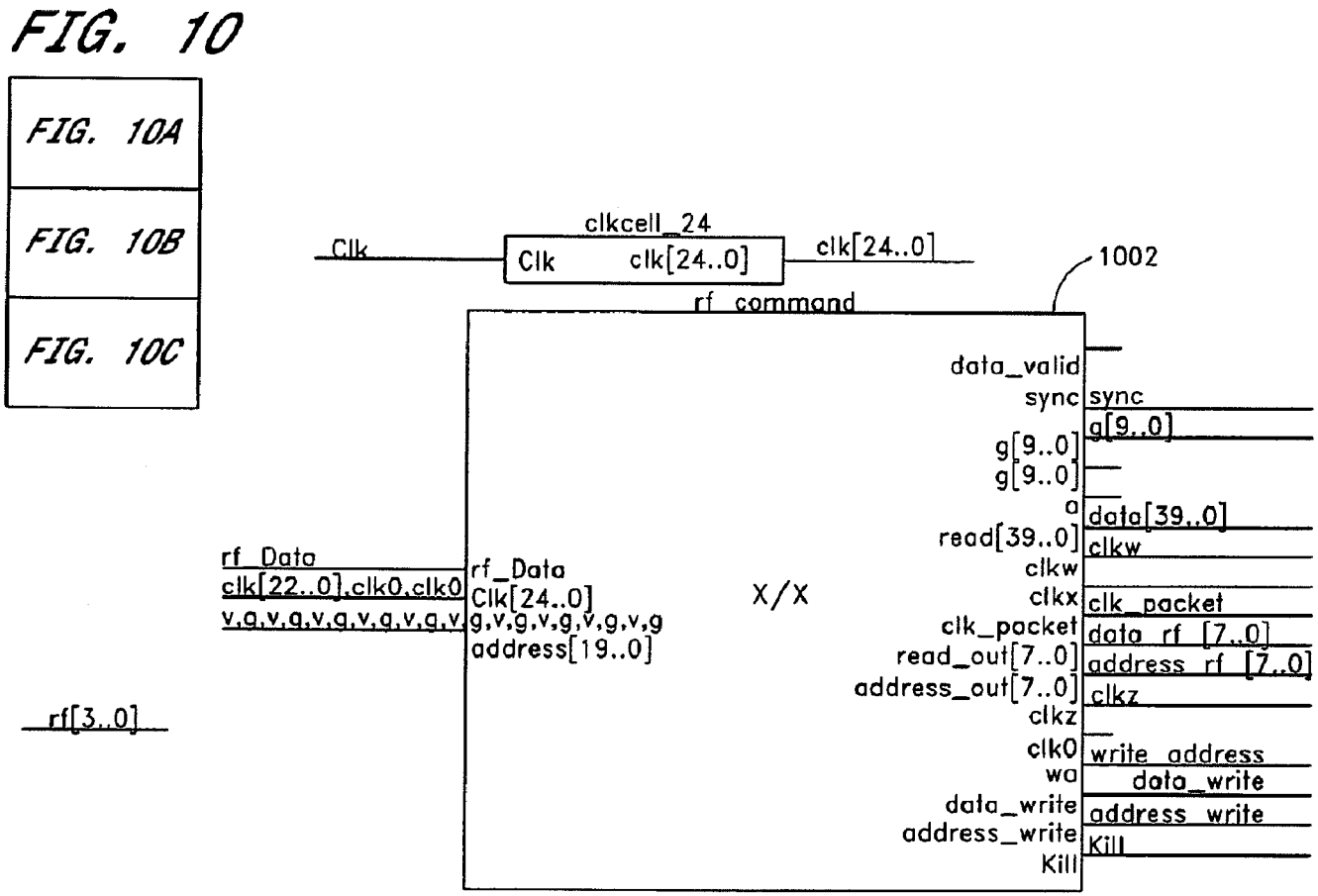
FIGS. 10A-10C illustrate block diagrams of an exemplary field programmable gate array (FPGA) of a motor controller of the automatic reel of FIG. 1.
Figure 10B:
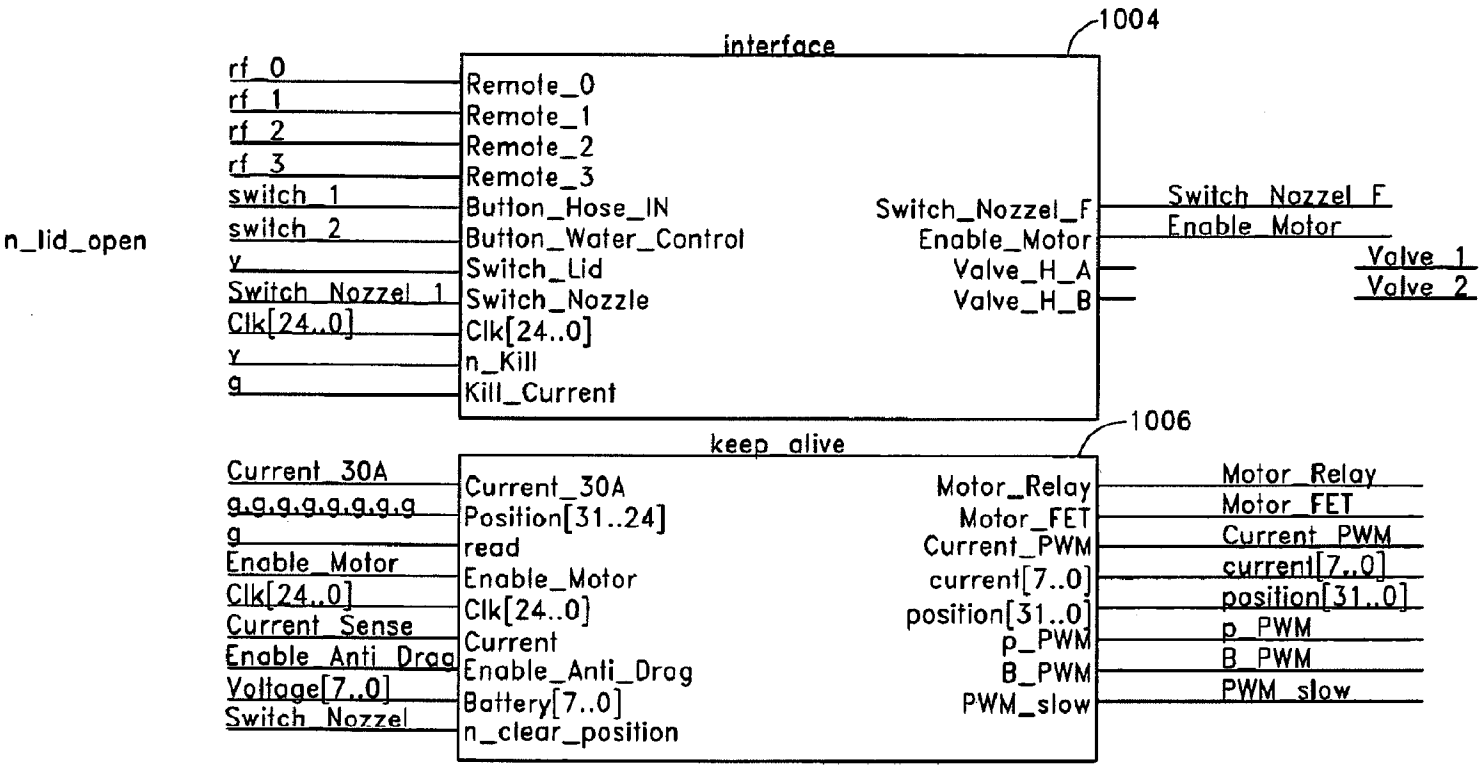

FIG. 10B illustrates an interface functional block 1004 that receives the internal signals from the RF command functional block 1002 and receives switch signals from the interface panel 106. The interface functional block 1004 processes the input signals and generates signals to control the motor 222 and the water control valves.

A motor control functional block 1006 illustrated in FIG. 10B is responsive to signals from the interface functional block 1004 and is also responsive to signals caused by the operation of the motor 222. The motor control functional block 1006 generates PWM signals, a direction signal and a hose position signal.

Figure 10C:
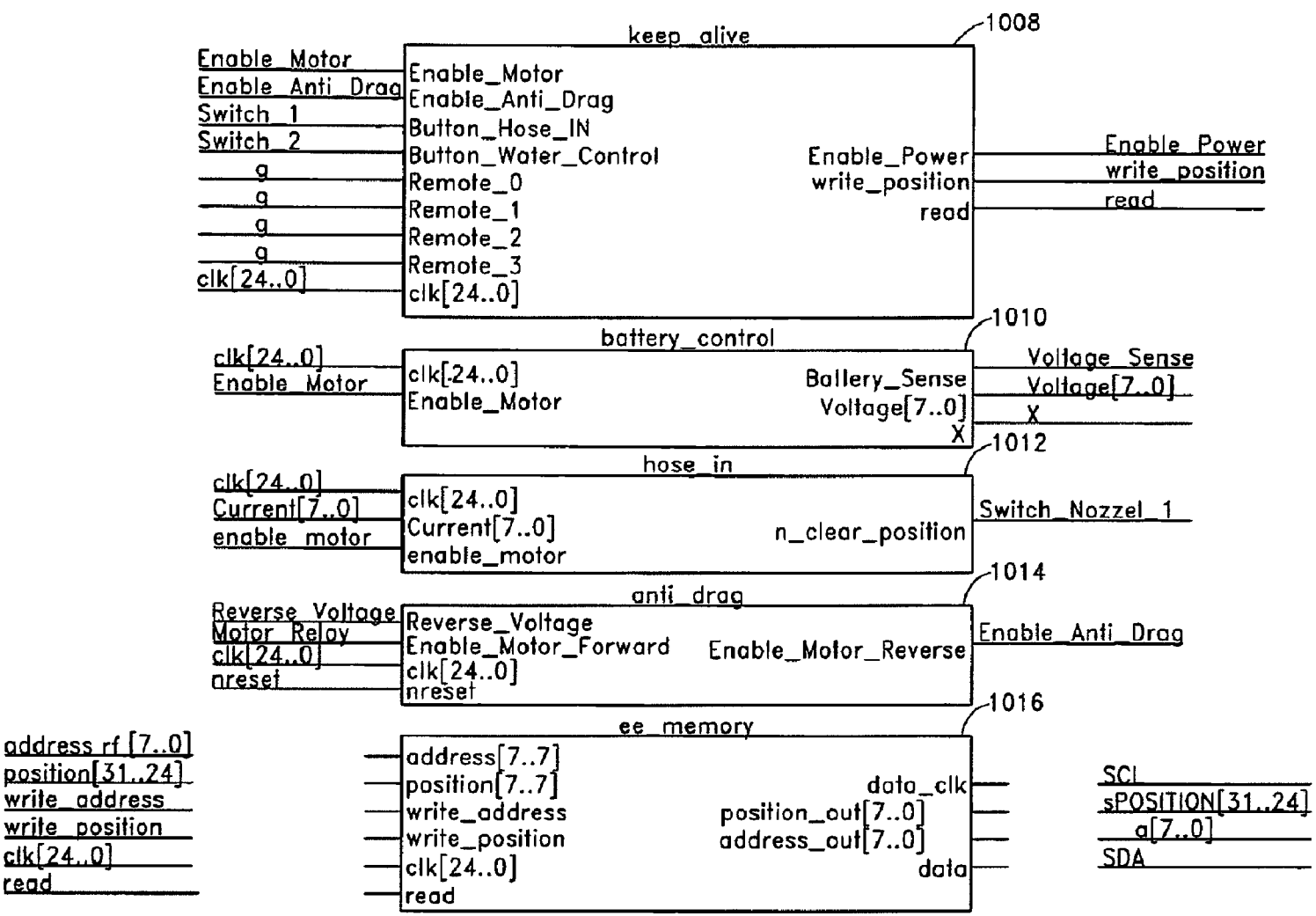

FIG. 10C illustrates a "keep alive" functional block 1008 that controls the power applied to the motor controller 224 in accordance with the timing of the operation of the switches, as described above; a battery control functional block 1010 that monitors the state of the battery and determines whether sufficient power is available to operate the motor controller 224; a "hose-in" (or "home") functional block 1012 that determines whether the hose is in the home position in accordance with the current sensing discussed above; an "anti-drag" functional block 1014 that is responsive to the reverse EMF sensed when a user is pulling the hose from the drum 220 and that generates an enable anti-drag signal to cause the motor controller 224 to operate the motor 222 in the reverse direction to assist the user; and an "ee-memory" functional block 1016 that provides control signals to an electrical erasable memory (described below) in response to command signals from the RF command functional block 1002 and in response to signals from the "keep alive" functional block 1008.

As further illustrated in FIG. 7A, the motor controller includes an electrically erasable programmable read only memory (EEPROM) 770, which in one preferred embodiment is a 24LC01B available from Microchip Technology. The EEPROM 770 receives serial data (SDA) and serial clock (SCL) from the ee-memory functional block 1016 of the FPGA 700 and selectively stores and retrieves data. For example, the EEPROM 770 stores the current hose position when the motor controller 224 is powered down during the sleep mode. Thus, the FPGA 700 can retrieve the previously stored hose position when the motor controller 224 is powered up and returns to the active mode. The EEPROM 770 also stores the address of the RF link when the automatic reel 100 and the remote controller 400 are synchronized, as discussed above.

In the illustrated embodiment, the Cyclone FPGA 700 is an SRAM-based device that is reloaded with configuration data when power is applied to the device. As further illustrated in FIG. 7A, the motor controller includes a serial configuration device 772 that is coupled to the FPGA 700 to provide the configuration information to the FPGA 700 each time the FPGA 700 is powered up when the motor controller returns to active mode after being in the sleep mode. In the illustrated embodiment, the serial configuration device 772 is an EPCS1 flash memory device (e.g., an EPROM) from Altera Corporation. The configuration information provided to the FPGA 700 implements the functional blocks shown in FIGS. 10A-10C.

In an alternative embodiment, the FPGA 700 may advantageously be replaced by a microcontroller that is programmable to perform the functions performed by the FPGA 700.

Figure 8:
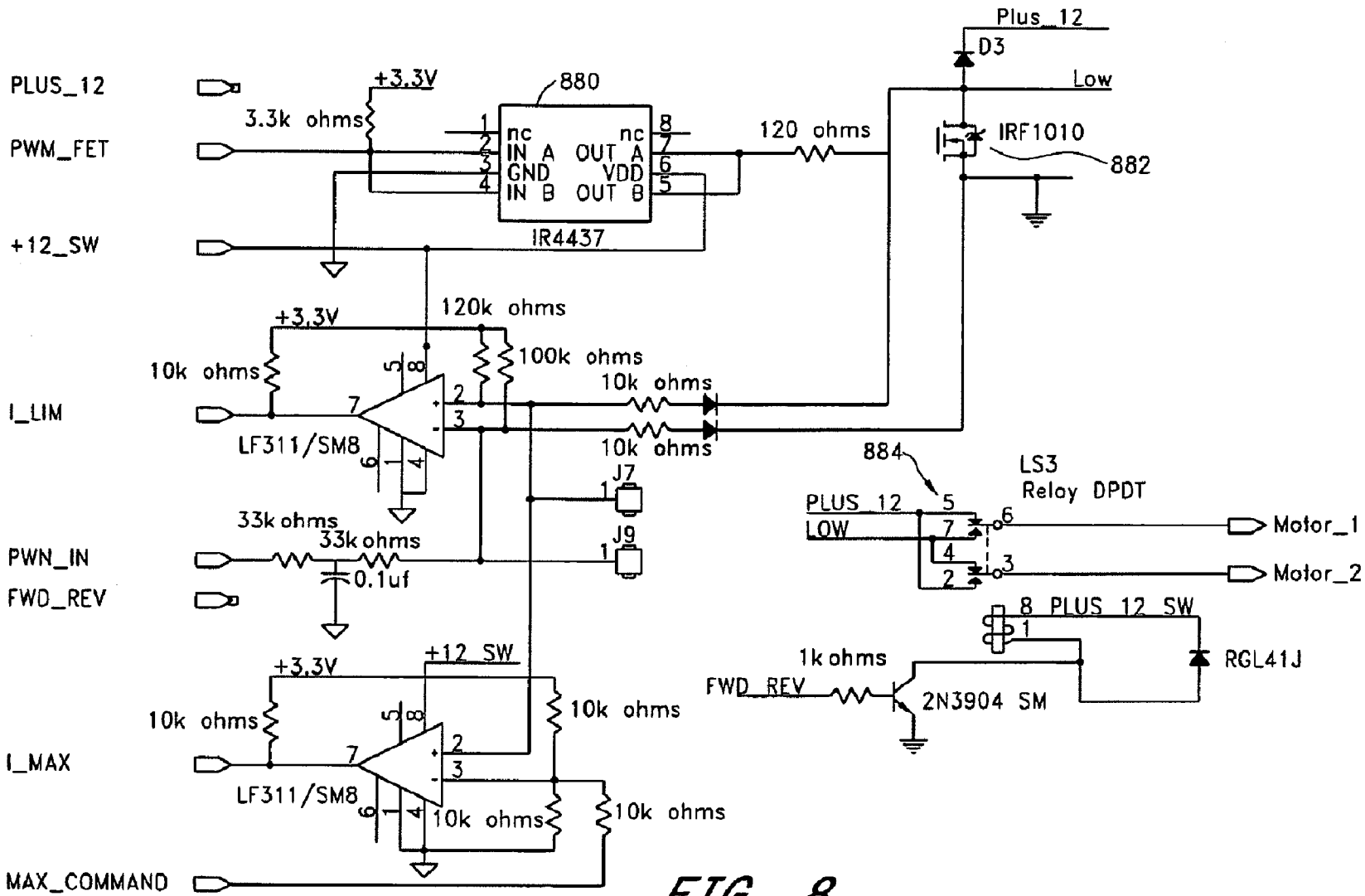

As illustrated in FIG. 8, the motor controller includes a power MOSFET driver 880, such as, for example, an IR4427 dual low side driver available from International Rectifier. The MOSFET driver 880 operates as a buffer between the FPGA 700 and a power MOSFET 882, such as, for example, an IRF1010 power MOSFET from International Rectifier. In particular, the MOSFET driver 880 receives a PWM_FET signal from the FPGA 700 in FIG. 7 and generates a gate driver signal to the power MOSFET 882. In the illustrated embodiment, the power MOSFET 882 is connected between the motor low supply line and ground to selectively connect the motor low supply line to ground. The motor high supply line is connected to the 12-volt supply. When the power MOSFET 882 is activated, the power MOSFET 882 provides a low-impedance connection between the motor low supply line and ground so that current flows from the 12-volt supply, through the motor and back to ground to cause the motor to turn.

As further illustrated in FIG. 8, the motor high supply line and the motor low supply line are connected to respective pairs of contacts of a double-pole, double-throw relay 884. The relay 884 has a first (upper) common contact connected to a motor_1 terminal and has a second (lower) common contact connected to a motor_2 terminal. The first common contact is associated with a first (upper) normally closed contact and a first (upper) normally open contact. Similarly, the second common contact is associated with a second (lower) normally closed contact and a second (lower) normally open contact. The motor high supply line is connected to the first normally closed contact and the second normally open contact. The motor low supply line is connected to the second normally closed contact and to the first normally open contact.

As a result of wiring the contacts in the above-described manner, when the relay 884 is inactive (e.g., no power applied to the relay coil), the motor high supply line is connected to the motor_1 terminal via the first normally closed contact and the first common contact, and the motor low supply line is connected to the motor_2 terminal via the second normally closed contact and the second common contact. Thus, whenever the power MOSFET 882 is active (e.g., whenever a PWM pulse is applied to the MOSFET driver 880), current flows through the coils of the motor from the motor_1 terminal to the motor_2 terminal to cause the motor to rotate in the forward direction (e.g., to retract the hose into the automatic reel 100).

When power is applied to the relay coil via a FWD_REV signal generated by the FPGA 700, the normally closed contacts are disengaged from the respective common contacts of the relay 884, and the normally open contacts engage the respective common contacts. Thus, the motor high supply line is connected to the motor_2 terminal via the second normally open contact and the second common contact, and the motor low supply line is connected to the motor_1 terminal via the first normally open contact and the first common contact. Thus, when the MOSFET 882 is activated while the relay coil is active, the current flows through the coils of the motor in the opposite direction from the motor_2 terminal to the motor_1 terminal to cause the motor to turn in the reverse direction (e.g., to assist the user in ejecting hose from the automatic reel 100).

As further illustrated in FIG. 8, the motor controller includes a current limit sensor comprising a first LM311 voltage comparator available from National Semiconductor. The first comparator has an inverting (−) input, a non-inverting (+) input and an output. The output of the first comparator is high when a voltage applied to the non-inverting input is greater than a voltage applied to the inverting input. The output of the first comparator is low when the voltage applied to the inverting input is greater than the voltage applied to the non-inverting input.

The non-inverting input of the first comparator is connected to sense the voltage developed across the low impedance of the power MOSFET 882 with respect to ground whenever the power MOSFET 882 is conducting current from the motor to ground.

The inverting input of the first comparator receives an input voltage responsive to a PWM_IN signal generated by the FPGA 700. The PWM_IN signal from the FPGA 700 is applied to a low-pass filter comprising a 33,000-ohm input resistor, a 0.1 microfarad capacitor, and a 33,000-ohm output resistor. The PWM_IN signal has a duty cycle selected by the FPGA 700 to correspond to an expected current required to operate the motor at a speed determined by the PWM_FET signal applied to the MOSFET driver 880. The low-pass filter operates to produce a filter output voltage responsive to the duty cycle of the PWM_IN signal. The filter output voltage is applied to the inverting input of the first voltage comparator so that the filter output voltage is compared to the voltage across the power MOSFET 882 on the non-inverting input.

The output of the first comparator produces an I_LIM signal that is high when the sensed voltage is greater than the filter output voltage and that is low when the sensed voltage is less than the filter output voltage. The FPGA 700 can determine the current flowing through the motor by adjusting the duty cycle of the PWM_IN signal to cause the I_LIM signal to switch levels. The value of the duty cycle of the PWM_IN signal when the I_LIM signal switches levels is correlated by the FPGA 700 to produce a measured current value.

The FPGA 700 compares the measured current value determined by the foregoing technique with an expected current value for a desired motor speed as determined by the duty cycle of the PWM_FET signal applied to the MOSFET driver 880. In particular, the amount of current required by the motor is responsive to the reverse EMF of the motor, and the reverse EMF of the motor is responsive to the speed of the motor. Thus, the measured current value indicates the speed of the motor.

If the FPGA 700 determines that the measured current does not correspond to the expected current for the desired motor speed, the FPGA 700 advantageously adjusts the duty cycle of the PWM_FET signal applied to the MOSFET driver 880 to selectively increase or decrease the motor speed while continuing to measure the current in accordance with the foregoing manner. Thus, the FPGA 700 uses the feedback information provided by the current measuring technique to control the speed of the motor to a desired motor speed.

By controlling the motor speed in the foregoing manner, the FPGA 700 is able to calculate the hose position based on the motor speed and the amount of time during which the motor is running at a particular motor speed.

The motor controller includes a second LM311 voltage comparator. The non-inverting input of the second comparator is connected to sense the voltage across the power MOSFET 882 and thus to sense the current flowing through the motor. The inverting input of the second comparator is connected to a bias network. The bias network provides a voltage on the inverting input that is set to a value selected to correspond to a sensed voltage across the power MOSFET 882 corresponding to a motor current of approximately 42 amperes. The output of the second comparator produces an I_MAX signal. When the motor current exceeds approximately 42 amperes, the second comparator switches the I_MAX signal to an active level.

When the FPGA 700 senses the active I_MAX signal, the FPGA 700 selectively adjusts the PWM_FET signal to reduce the duty cycle applied to the motor to reduce the current through the motor. If this results in the I_MAX signal switching to an inactive level, the FPGA 700 selectively maintains the PWM_FET signal at the new duty cycle and may subsequently increase the duty cycle to return the motor to the original speed. Thus, for example, the FPGA 700 maintains the current below the maximum level to provide an opportunity for the hose to disengage from a temporary obstruction. On the other hand, if the current remains above the maximum level, the FPGA 700 selectively further reduces the duty cycle of the PWM_FET signal to further reduce the current. The reduction in duty cycle and resulting reduction in current continues until either the current is reduced below the maximum level or the motor is turned off.

In accordance with the described technique, the detection of a current level above the maximum current level does not result in an immediate shut down of the motor, which can result in a large current spike. Rather, the current to the motor is gradually reduced, thus eliminating the large current spike. The gradual current reduction also provides an opportunity for the obstacle to be overcome by the continuing force applied to the hose by the motor.

As further illustrated in FIG. 8, the motor controller includes an optional MAX_command input signal line that is coupled to the inverting input of the second comparator. A voltage applied to the MAX_command input signal line advantageously increases the voltage applied to the inverting input to increase the maximum current threshold. For example, a voltage can advantageously be applied to the MAX_command input line to increase the maximum current threshold in order to use the automatic reel 100 in applications where the force required to wind the linear material is greater and more motor current is required. For example, when the automatic reel 100 is used to wind a stiff hose, such as, for example, a pneumatic hose, more force, and thus more current, may be required.

Figure 9:
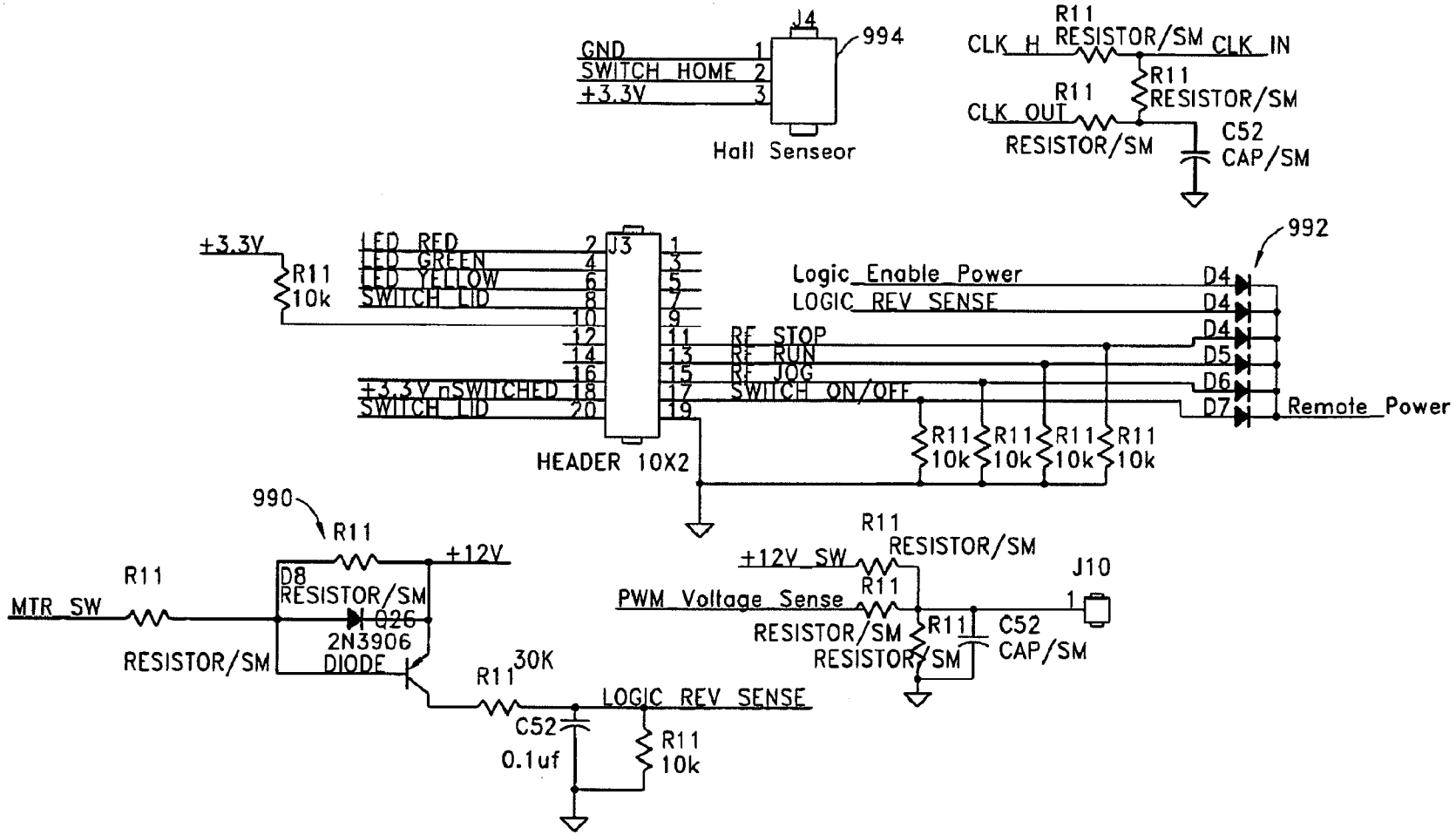

As illustrated in FIG. 9, the motor controller includes a reverse EMF sensor 990 that comprises a PNP transistor having an emitter connected to the 12-volt supply and having a base coupled to receive an MTR_SW input signal from the low supply line of the motor. The collector of the PNP transistor provides a LOGIC_REV_SENSE output signal that is pulled low by a pulldown resistor when the PNP transistor is off. The PNP transistor is normally off when no voltage is applied to the base of the PNP transistor, such as when the motor is not activated. When the motor is turned on by activating the power MOSFET 882, the low supply line of the motor is pulled low and the base of the PNP transistor is pulled low to turn on the PNP transistor. When the PNP transistor is on, the voltage on the collector of the PNP transistor is pulled up toward the 12-volt supply voltage, which results in an active high LOGIC_REV_SENSE signal. However, when the PWM signal is being generated, the FPGA 700 ignores the active LOGIC_REV_SENSE signal.

If the PWM signal is off and the power MOSFET signal is thus off, the low supply line of the motor is normally high. If the motor is caused to turn in the reverse direction by a user pulling on the hose and rotating the drum, the motor operates as a generator to produce a generated EMF signal to cause the voltage on the low supply line to the motor to become low relative to the voltage on the high supply line to the motor. The low voltage is applied to the base of the PNP transistor to cause the PNP transistor to turn on to activate the LOGIC_REV_SENSE signal.

Since the FPGA 700 is not generating PWM signals during this time, the FPGA 700 determines that the motor is being turned by the action of a user pulling the hose from the drum. Thus, the FPGA 700 activates the relay 884 and generates PWM signals to cause the motor to turn in the reverse direction to assist the user.

As discussed above, during the drag-assist function, the FPGA 700 generates the PWM signals with a lower duty cycle so that the motor provides just enough power to assist the user rather than ejecting the hose from the automatic reel 100 at a high rate. While the drag assist function is active, the FPGA 700 periodically determines whether the user is continuing to pull on the hose when the PWM signal is inactive (e.g., during the portions of the PWM duty cycle when the MOSFET is turned off) to determine whether to continue providing reverse power to assist the user.

As further illustrated in FIG. 9, the motor controller includes a plurality of diodes 992 having their cathodes connected in common and having their anodes connected to respective sources of power control signals. When one or more of the power control signals is active high, a remote power signal is active high to activate the first three voltage regulators in FIG. 6. For example, wires from the interface panel 106 are connected to the motor controller via a header J3. Three outputs of the RF receiver are thus coupled to three of the plurality of diodes 992 in FIG. 9. Thus, when the RF receiver activates a respective output in response to the stop command, the home command, or the jog command from the remote controller, the remote power signal is activated.

One of the diodes 992 is connected to a switch on the interface panel 106 that can be selectively activated by a user to activate the motor controller. One of the diodes 992 is connected to the LOGIC_REV_SENSE signal to activate the motor controller when the motor is turning in reverse in response to the user pulling on the hose. Another diode is connected to a logic enable power signal that is generated by the FPGA 700 after being activated into the active mode by one of the other signals. Thus, the FPGA 700 can keep the motor controller active until a function is completed and no other control signals are being received, as discussed above.

The motor controller 224 also includes a Hall effect sensor 994 that senses when the reciprocating hose mechanism within the body 102 of the automatic reel 100 is in a particular position.

The benefits of the automatic reel 100 described above provide a less expensive and more productive manner in which to manage linear material. Because the main components of the automatic reel 100 comprise the drum 220, the motor controller 224 and the motor 222, the automatic reel 100 is more reliable. In addition, complicated and expensive clutch systems for neutralizing the motor 222 and encoders for tracking the amount of retracted hose are avoided.

Having thus described the preferred embodiments of the present invention, those of skill in the art will readily appreciate from the disclosure herein that yet other embodiments may be made and used within the scope of the claims hereto attached. For example, the automatic reel may be used with types of linear material other than water hoses, such as air hoses or pressure washer hoses. Numerous advantages of the invention covered by this disclosure have been set forth in the foregoing description. It will be understood, however, that this disclosure is, in many respects, only illustrative. Changes may be made in details without exceeding the scope of the disclosure.

What is claimed is:

1. An automated method for spooling or deploying linear material, comprising:

receiving a wireless signal;

instructing a motor to rotate a rotatable member so as to cause a linear material to spool onto or deploy from the rotatable member, wherein instructing comprises responding to the wireless signal by determining a number of revolutions, and instructing the motor to rotate the rotatable member by the determined number of revolutions; and using the motor to begin rotating the rotatable member by the determined number of revolutions.

2. The method of claim 1, wherein instructing further comprises determining a direction in which to rotate based at least in part on the received wireless signal.

3. The method of claim 1, wherein determining the number of revolutions comprises accessing a predefined value stored in a machine-readable memory.

4. The method of claim 1, further comprising:

while the rotatable member is rotating, receiving a second wireless signal; and responding to the second wireless signal by instructing the motor to cease rotating the rotatable member.

5. An automated method for spooling or deploying linear material, comprising:

receiving a wireless signal;

instructing a motor to rotate a rotatable member so as to cause a linear material to spool onto or deploy from the rotatable member, wherein instructing comprises responding to the wireless signal by determining a time period, and instructing the motor to rotate the rotatable member at a said predefined speed for the determined time period; and using the motor to begin rotating the rotatable member at said predefined speed for the determined time period.

6. The method of claim 5, farther comprising:

while the rotatable member is rotating, receiving a second wireless signal; and responding to the second wireless signal by instructing the motor to cease rotating the rotatable member.

7. An automatic reel system for spooling or deploying linear material, comprising:

a rotatable member;

a motor configured to rotate the rotatable member so as to cause a linear material to spool onto or deploy from the rotatable member; and a motor control system configured to receive a wireless signal and respond to the signal by one of:

determining a number of revolutions, and instructing the motor to rotate the rotatable member by the determined number of revolutions; and determining a time period, and instructing the motor to rotate the rotatable member at a predefined speed for the determined time period.

8. The system of claim 7, wherein the motor control system is configured to respond to the signal by:

determining said number of revolutions; and instructing the motor to rotate the rotatable member by the determined number of revolutions.

9. The system of claim 8, wherein the motor control system is configured to determine the number of revolutions by accessing a predefined value stored in a machine-readable memory.

10. The system of claim 7, wherein the motor control system is configured to respond to the signal by:

determining said time period; and instructing the motor to rotate the rotatable member at said predefined speed for the determined time period.

11. The system of claim 10, wherein the motor control system is configured to determine the time period by accessing a predefined value stored in a machine-readable memory.

12. The system of claim 7, wherein the motor control system is further configured to:

receive a second wireless signal while the rotatable member is rotating; and respond to the second wireless signal by instructing the motor to cease rotating the rotatable member.

* * * * *